US005099591A

United States Patent [19]

Eiklor et al.

[11] Patent Number: 5,099,591

[45] Date of Patent: Mar. 31, 1992

[54] FIREPLACE SOUND SIMULATOR

[76] Inventors: Scott F. Eiklor, 11711 Kenneth, Box 861; Steve F. Eiklor, 10809 North Church, Box 804, both of Huntley, Ill. 60142

[21] Appl. No.: 602,674

[22] Filed: Oct. 24, 1990

[51] Int. Cl.[5] ..... A63J 5/00; G04F 13/36

[52] U.S. Cl. ..... 40/428; 472/64

[58] Field of Search ..... 272/8 F, 14, 15; 40/428

[56] References Cited

U.S. PATENT DOCUMENTS

| | | | |
|---|---|---|---|
| 3,499,239 | 3/1970 | Mungo | 40/428 |
| 3,526,984 | 9/1970 | Nielsen et al. | 40/428 |
| 3,978,598 | 9/1976 | Rose et al. | 40/428 |
| 4,026,544 | 5/1977 | Rambeck et al. | 272/14 |

*Primary Examiner*—Richard E. Chilcot, Jr.

*Attorney, Agent, or Firm*—Wallenstein, Wagner & Hattis, Ltd.

[57] ABSTRACT

A fireplace-mountable sonic generator produces random noise pulses of varying amplitude imitative of the crackling of a fire, and is particularly suited to emplacement within fireplaces which simulate a log fire by passing burning illuminating gas over a refractory imitation log. The sounds are produced by a reed repeatedly flexed away from a striker plate and then released to impact against that plate, producing a characteristic crackling sound. A series of such deflections and releases at apparently random times is provided by a motor-driven rotating drum having series of surface-mounted, radially-extending irregularly spaced projections. The end of the reed is disposed to be engaged by the drum projections as they move past. Variations in sound intensity from one sound burst to the next may be achieved by varying the lengths of the projections, or by varying their overlap distance as measured from the center of the reed.

20 Claims, 1 Drawing Sheet

FIREPLACE SOUND SIMULATOR

TECHNICAL FIELD OF THE INVENTION

The technical field of the invention is appliances for use in conjunction with fireplaces.

BACKGROUND OF THE INVENTION

Various systems have been employed to make a gas-fit fireplace realistically resemble a burning log fire. Currently systems are known wherein burning illuminating gas is fed up from some form of substrate, such as through a sand bed, which is heated to incandescence by the burning gas to resemble a bed of coals, the burning gas also passing up and around a synthetic log made of refractory material. The visual simulation of a burning log can be very effectively and realistically simulated by such methods; however, the sound of a crackling fire is characteristic absent. Although electronic sonic generators and loudspeakers may readily be configured to generate such sounds to add realism, such approaches are expensive, and essential parts of the system cannot be safely placed within the radiant heat zone of the fireplace. An economical solution to this problem, and in particular a sonic generator which can withstand elevated temperatures in the immediate vicinity of a fire, has yet to be provided.

SUMMARY OF THE INVENTION

A sonic generator is designed for use with gas fireplaces which replicate the burning of a log by passing burning illuminating gas around refractory material configured to resemble a log. The generator emits sonic pulses at irregular intervals to produce sounds of varying magnitude imitative of the noise of a crackling fire. The illusion of a burning log is thus enhanced. According to the broadest aspect of the invention, the sounds are produced by elongated resilient reed means mounted to be engaged by motor-driven pick means which deflect a free end of the reed means periodically, and thereafter release it. Upon release, the reed means recoil to impact against striker means mounted proximate to the reed means to produce the desired crackling sounds.

According to related features of the invention, and in the preferred form of the invention, the pick means are configured as a rotatably mounted cylindrical carrier rotatably driven by a motor. This carrier has a plurality of sequential extensions disposed to flex the reed means away from the striker means when the carrier means is rotated. The carrier means then carries the extensions to a subsequent releasing position, and allows the reed means to snap back and strike the striker means. The crackling sounds are produced at irregularly timed intervals by spacing the extensions irregularly around the surface of the carrier drum.

A variation in amplitude from one crackling sound to the next may be provided by extensions of varying length. Alternatively, extensions of uniform length may be employed, and distributed over an annular band on the cylindrical surface of the carrier. The end of the reed which is deflected by engagement with the extensions is curved, so that as the cylinder rotates, the path of arcuate engagement varies according to the axial position of the extensions.

A housing is provided for the generator. This housing includes an aperture directing the sound from the sonic generator towards the listener. The motor is preferably of the wind-up spring-type, allowing the entire system to be made solely of metallic elements, so as to withstand the high temperatures produced in the vicinity of the combustion zone of a fireplace. Alternatively electric motors may be used for remote emplacements.

Other advantages and aspects of the invention will become apparent upon reference to the specification, claims, and drawings to follow.

DESCRIPTION OF THE DRAWINGS

FIG. 4 is an expanded view of a portion of the mechanism shown in FIG. 2; and, FIG. 5 is a cutaway view of a portion of the mechanism shown in FIG. 4 and taken along the cut lines 5—5.

DETAILED DESCRIPTION OF THE INVENTION

Figure 1:
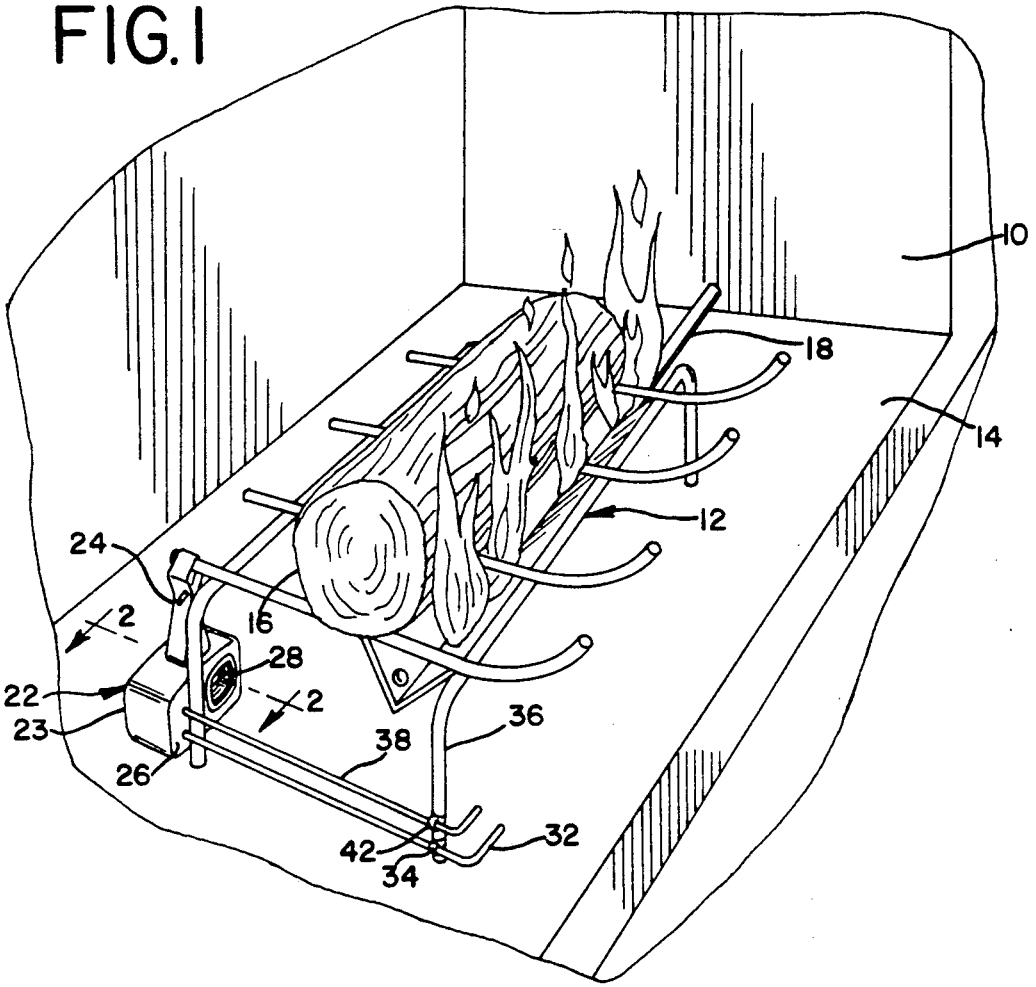
FIG. 1 is a perspective view of a fireplace showing a gas-fired refractory log and the sonic generator of the invention emplaced therein.

While this invention is susceptible of embodiment in many different forms, there is shown in the drawings and will be described in detail a preferred embodiment of the invention. It should be understood that the present disclosure is to be considered as an exemplification of the principles of the invention, and is not intended to limit the broad aspect of the invention to embodiment illustrated.

The drawings, and in particular FIG. 1, show a fireplace 10 having a grate 12 supported on the fireplace floor 14. A refractory imitation log 16 is placed upon the grate 12. Illuminating gas is supplied from a gas pipe 18, and flows upward to surround the log with flames The sonic generator 22 includes a housing 23 affixed to a rear portion of the grate 12 by means of a bracket 24. The generator 22 emits crackling sounds of varying intensity at apparently random intervals to imitate the crackling of a fire. The sound is directed outward from the front face 26 of the generator via an aperture 28.

The motor drive system contained within the housing 23 is preferably of the spring-wound music box motor type. To wind up the motor drive system, a winding shaft 32 extends forward from the housing front surface 26 and is supported at its outermost end by a sleeve 34 affixed to a forward support member 36 forming part of the grate 12. As is customary in such music box motors, the winding occurs upon rotation of the winding shaft 32. A start and stop shaft 38 similarly extends from forward from the housing front surface 26, and has its outer end similarly supported to grate support member 36 by a sleeve 42. The motor is released to a free-running condition by sliding the start-stop shaft 38 forward, and is shut down by sliding it backward towards the housing 23.

Figure 2:
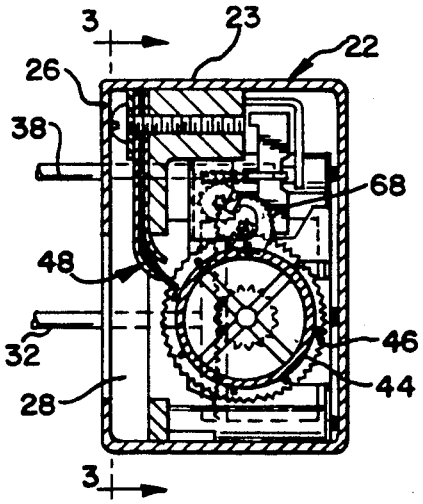
FIG. 2 is a cross-section view of the sonic generator shown in FIG. 1 taken along cut lines 2—2.
Figure 3:
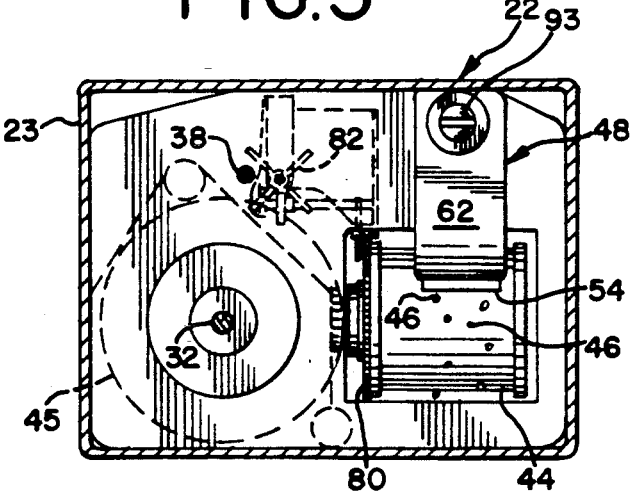
FIG. 3 is a partial cross-section view of the sonic generator shown in FIG. 1 taken along cut lines 3—3.

Referring to FIGS. 2 and 3, the desired noise pulses are produced by a cylindrical drum 44 driven by a motor 45 and having a number of generally randomly distributed radially extending projections in the form of pegs 46—46. A reed assembly 48 affixed to a frame 52 contains a resilient reed 54 extending generally co-planarly with the rotational axis 56 of the drum 44 so that the outer end 56 of the reed 54 closely approaches the outer surface 58 of the drum. FIGS. 4 and 5 shown enlarged details of the reed assembly 48.

As the pegs 46—46 are driven into engagement with the reed end 56, the reed 54 is deflected. Further travel of the engaging peg ultimately causes the reed end 56 to be released, causing the reed 54 to snap back against a striker plate 62 to emit the desired crackling sound through an aperture 64 in the frame 52 (FIG. 3), and then through the aperture 28 in the housing 23 (FIGS. 1 and 2).

The assembly shown in FIG. 3 is a modification of a music box-type wind-up motor assembly manufactured by Sankyo Manufacturing Co., Ltd., of Tokyo under Model No. 18N-Y164. The motor 45 is energized by winding up a wind-up shaft 32. Intermediate gearing (some portions not shown), e.g., 68, transfer motor power to rotate the drum 44 via an integral drive gear 80. A velocity-stabilizing rotor 82 is also driven into rotation FIG. 3 shows that the stop-start shaft 38 slides inwardly into the frame 52 to arrestingly engage the rotor 82, thereby stopping rotation of the drum 44. Withdrawal of the shaft 38 frees the rotor 82 to resume rotation Referring to FIG. 4, the reed 54 is preferably made of resilient metal. In the exemplary form of the invention, the reed is actually prepared by a suitably configured portion of feeler stock 0.018 inches thick and about ½" wide. The striker plate 62 and a clamp plate 86 are configured from 18 gauge cold-rolled steel strips Both the striker plate 62 and the clamp plate 86 have parallel planar upper ends 93 held together in compression and affixed to the frame 52 by a clamp screw 93. The upper end 94 of the reed 54 extends partially upward between the parallel upper ends 88, 92 of the striker plate 62 and clamp plate 86, and are captively held between those elements.

The lower ends 95, 96 of the striker plate 62 and clamp plate 86 are both provided with an arcuate bend so that their respective ends point generally towards the proximate surface of the drum 44. The lower end 96 of the clamp plate 86, however, has a greater degree of curvature than does the corresponding lower end 95 of the striker plate 62. Accordingly, the reed 54 is stressed so that it is in contact with an impact line 97 at the extreme lower end 94 of the striker plate and along a similar linear region 98 near the end of the clamp plate 86. Thus, the lower portion of the reed 54 is essentially in stress against the impact line 97. A portion of the reed 54 extending beyond the impact line 97 is thus planar, and extends generally towards the axis of rotation 56 of the drum 44.

As the drum 44 is rotated clockwise as shown in FIG. 4, the extension pegs 46—46 are brought into sequential engagement with a face of the lower end of the reed 56. This forces the reed 54 to the right in the figure, moving the reed end 56 away from the striker plate. Further advance of the engaging peg 46 will ultimately cause release of the reed 54, which is then elastically returned to forcibly strike the striker plate 62 and emit the desired sound.

The extension pegs 46—46 are preferably distributed irregularly about the periphery of the drum 44 to produce a series of snapping sounds that appear to be random in time. However, it will be appreciated that, since the drum rotates a great many times, the resulting train of sounds is not truly random. Since the period of rotation of drums driven by motor drive systems as described herein is typically of the order of half a minute or thereabouts, the true pseudorandom nature of the pulses is obscured, and they appear to be genuinely random to the listener.

To cause the resulting sound bursts to vary in strength from one burst to the next, thereby increasing the similarity to crackling sound of an actual fire, several approaches may be employed. The detail view of FIG. 5 is of particular relevance. The reed end 56 is formed as an arcuate terminal contour of the end of reed 54. Additionally, in this example, the posts 46—46 are all configured to be of uniform height, but distributed axially along the surface 58 of the drum 44 within an annular band 102 generally no wider than the width of the reed 54. A centrally located peg, such as **46*b*, will advance to engage the reed end 56 with considerably overlap as shown by the dotted outline 46*b*'. This will cause substantial deflection of the reed 54 before release, and produce a relatively loud sound. On the other hand, a post 46*a* positioned to strike the reed 54 off-center, as shown by the dotted outline 46*a*'**, has a substantially reduced overlap of the reed at the time of initial contact. As a result, there will be less flexing of the reed before release, and a weaker sound.

It should also be recognized that if the reed 54 is of sufficiently thin material, a significant amount of local flexure will result, particularly from off-center strikes. Thus, even if the reed end 56 is straight, instead of curved as shown in FIG. 5, peg **46*a* may succeed in deflecting only the left half of the reed 54 away from the striker plate. Upon release from the peg 46*a*, a lesser portion of the reed 56 will impact upon the striker plate 62, and a correspondingly weaker sound will be made when it snaps back to contact the plate. Finally, pegs 46** may be made of varying height to accomplish similar objectives; however, this requires additional manufacturing complexity.

Although the motor assembly as manufactured contains several plastic gear parts and a plastic rotor 82, these components are made of Nylon TM, and have substantial high temperature resistance. A fully equivalent system replacing the aforementioned plastic parts by metal parts may readily be provided, but at increased cost. Also, although the generator 22 is shown in FIG. 1 emplaced within a fireplace, it may equally well be employed at suitable locations proximate to a fireplace. For example, the generator 22 may be placed in front of, or to one side of, the fireplace. In such cases the spring motor may be replaced by an electrically driven motor operated by either battery power or line power.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

What I claim is:

1. A sonic generator for use with a gas-fed fireplace for producing sounds imitative of the crackling of a fire, comprising:

elongated resilient reed means mounted to first support means at one end thereof;

striker means mounted to second support means and disposed in confronting relationship to a portion of the other end of said reed means for arresting said reed means when deflected into contact with said striker means;

pick means operable to a first position for engagingly deflecting at least a region of said other end of said reed means away from said striker means and to a second position for releasing said engagement thereafter to cause said region of said reed means to strike said striker means;

motor drive means for driving said pick means cyclically between said first and said second positions to produce a sequential series of said strikings; and means for causing said strikings to occur apparently randomly in time.

2. The sonic generator of claim 1 wherein said pick means includes a plurality of members driven by said motor drive means, each disposed to engagingly deflect at least a region of said other end of said reed means away from said striker means and to thereafter release said engagement to cause said region of said reed means to strike said striker means, and including means for causing the release of a series of engagements to occur as a pseudorandom sequence in time.

3. The sonic generator of claim 1 wherein said pick means includes a plurality of members driven by said motor drive means each disposed to engagingly deflect at least a region of said other end of said reed means away from said striker means and to thereafter release said engagement to cause said region of said reed means to strike said striker means, and including means for causing the sound amplitude of sounds produced by a series of releases to vary over a range of values.

4. The sonic generator of claim 1 wherein said reed means is mounted to be resiliently biased against said striker means in the dormant state of said reed means.

5. The sonic generator of claim 1 wherein said other end of said reed means includes a portion configured as a planar resilient member engageable with said pick means.

6. The sonic generator of claim 1 wherein said pick means includes rotatably mounted carrier means coupled to be driven into rotation about an axis by said motor drive means and having at least one extension extending along a line perpendicular to said axis and disposed to engagingly flex said reed means away from said striker means attendant to partial rotation of said carrier means, said carrier means carrying said extension to a releasing position attendant to further rotation of said carrier means to allow said reed means to snap back to strike said striker means.

7. The sonic generator of claim 6 wherein said pick means includes a plurality of members sequentially driven by said motor drive means each disposed to engagingly deflect at least a region of said other end of said reed means away from said striker means and to thereafter release said engagement to cause said region of said reed means to strike said striker means, and including means for causing the release of a series of engagements to occur as a pseudorandom sequence in time.

8. The sonic generator of claim 7 wherein said carrier means is configured as a cylinder mounted for rotation about the axis thereof and having a plurality of said extensions thereon extending radially outward from the surface of said cylinder, and said means for causing the release of a series of engagements to occur as a pseudorandom sequence in time includes said extensions disposed at irregular angular intervals around the periphery of said cylinder.

9. The sonic generator of claim 8 wherein said other end of said reed means includes a portion configured as a planar resilient member engageable with said extensions and oriented with the plane of said reed portion disposed to lie generally coplanar with said axis.

10. The sonic generator of claim 9 wherein the lengths of said extensions are chosen to provide a varying overlap with respect to said reed end portion so that when driven sequentially therepast the release points vary to produce sounds of varying amplitude.

11. The sonic generator of claim 9 wherein said reed end portion is configured as an arc having a varying distance along its length with respect to the surface of said cylinder, said extensions are disposed axially as well as peripherally on said surface of said cylinder, and the lengths of said extensions are generally equal to provide varying degrees of overlap with respect to said reed end portion so that when driven sequentially therepast the release points vary to produce sounds of varying amplitude.

12. The sonic generator of claim 1 wherein said striker means engages said reed means at a point intermediate said one end and said other end of said reed means.

13. The sonic generator of claim 12 wherein said reed means is mounted to be resiliently biased against said striker means in the dormant state of said reed means.

14. The sonic generator of claim 1 including housing means for containing said reed means, said pick means, and said motor drive means, said housing having aperture means for allowing sounds to escape therefrom, and said motor drive means includes a windup-type spring motor having a windup shaft extending from said housing.

15. The sonic generator of claim 14 including a movably mounted control shaft extending from said housing and said motor means has associated therewith means for starting and stopping said motor means responsively to the position of said control shaft.

16. The sonic generator of claim 1 wherein said striker means includes an elongated rigid generally strap-shaped striker member fixedly secured at one end thereof to said second support means and having a curved portion at the other end thereof, said sonic generator including a rigid elongated generally strap-shaped clamp plate, said reed means including an initially planar resilient strap-shaped member compressingly secured at said one end thereof between portions of said clamp plate and said striker member and extending beyond the other ends of said striker member and said clamp plate to be stressed into resilient engagement against said other end of said striker member.

17. The sonic generator of claim 8 wherein said striker means engages said reed means at a point intermediate said one end and said other end of said reed means.

18. The sonic generator of claim 8 including housing means for containing said reed means, said pick means, and said motor drive means, said housing having aperture means for allowing sounds to escape therefrom, and said motor drive means includes a windup-type spring motor having a windup shaft extending from said housing.

19. The sonic generator of claim 8 wherein said striker means includes an elongated rigid generally strap-shaped striker member fixedly secured at one end thereof to said second support means and having a curved portion at the other end thereof, said sonic generator including a rigid elongated generally strap-shaped clamp plate, said reed means including an initially planar resilient strap-shaped member compressingly secured at said one end thereof between portions of said clamp plate and said striker member and extending beyond the other ends of said striker member and said clamp plate to be stressed into resilient engagement against said other end of said striker member.

20. A sonic generator for use with a gas-fed fireplace for producing sounds imitative of the crackling of a fire comprising:

an elongated resilient reed having parallel major faces and mounted to first support means at one end thereof;

a rigid striker member mounted to second support means having a striker member portion in confronting relationship to one of said major faces at the other end of said reed for arresting said reed when deflected into contact with said striker member portion, said reed being mounted to be resiliently biased against said striker member portion;

rotatably mounted carrier means configured as a cylinder having a plurality of extension members extending radially outward from the surface of said cylinder and disposed for sequentially engaging said other end of said reed means to flex at least a portion of said reed means away from said striker member portion attendant to partial rotation of said carrier means, said carrier means carrying each said extension to a releasing position attendant to further rotation of said carrier means to allow said reed means to snap back to strike said striker member portion, said extensions being disposed at irregular angular intervals around the periphery of said cylinder to cause the sequential releases of said reed from said extension members to occur as a pseudorandom sequence in time; and motor drive means for rotatably driving said carrier means.

* * * * *